United States Patent [19]

Motyczyński et al.

[11] 3,976,422

[45] Aug. 24, 1976

[54] APPARATUS FOR RECLAMATION OF RESINOUS MOULDING MIXES

[75] Inventors: Ryszard Motyczyński; Tadeusz Franaszek; Mieczyslaw Kurzydło; Jerzy Polaczek, all of Krakow, Poland

[73] Assignee: Przedsiebiorstwo Projektowania i Wyposazania Odlewni "Prodlew", Warsaw, Poland

[22] Filed: Feb. 27, 1975

[21] Appl. No.: 553,546

[30] Foreign Application Priority Data

Mar. 4, 1974 Poland ..... 169283

[52] U.S. Cl. ..... 432/58; 34/62; 34/66; 432/80; 432/78

[51] Int. Cl.[2] ..... F27B 15/00

[58] Field of Search ..... 432/58, 14, 15, 784, 432/79, 80; 34/62, 66

[56] References Cited

UNITED STATES PATENTS

| | | | |
|---|---|---|---|
| 2,529,366 | 11/1950 | Bauer | 432/15 |
| 3,313,534 | 4/1967 | Frans | 432/58 |
| 3,480,265 | 11/1969 | Deve | 432/58 |
| 3,782,888 | 1/1974 | Cnare | 432/14 |
| 3,804,581 | 4/1974 | Schmalfeld et al. | 432/58 |
| 3,821,342 | 6/1974 | Hurd | 432/58 |
| 3,861,862 | 1/1975 | Steever et al. | 432/58 |
| 3,881,862 | 5/1975 | Nishida et al. | 432/14 |
| 3,920,380 | 11/1975 | Heian | 432/78 |

FOREIGN PATENTS OR APPLICATIONS

| | | | |
|---|---|---|---|
| 1,090,562 | 3/1955 | France | 432/79 |
| 966,023 | 7/1957 | Germany | 34/62 |

*Primary Examiner*—John J. Camby
*Assistant Examiner*—Henry C. Yuen
*Attorney, Agent, or Firm*—Haseltine, Lake & Waters

[57] ABSTRACT

An apparatus for reclamation of resinous moulding mixes used in foundry practice incorporates three chambers contained in a common housing, namely a heating chamber (3), a firing chamber (2) and a cooling chamber (4). A bottom (6) of the heating chamber forms a fluidizing conveyor conveying the moulding mix from a chute (8) to a closure (27) through which the mix drops onto a grate (5) of the firing chamber (2). The fuel is supplied through a system of collectors and nozzles to the clearances between the grate elements, while the air for fluidizing of the mix is supplied through a duct (14) to the space below the grate. The firing chamber is connected with the cooling chamber by means of the mix transfer holes (10) and (11). A bottom (12) of the cooling chamber forms a fluidizing conveyor conveying the mix to a discharge hold (24). The cooling chamber includes a cooler (23).

6 Claims, 3 Drawing Figures

APPARATUS FOR RECLAMATION OF RESINOUS MOULDING MIXES

The invention relates to an apparatus for reclamation of resinous moulding mixes and for recovery of a clean moulding sand.

There are known installations for thermal reclamation of resinous moulding mixes, these installations being built in the form of rotary, drum type furnaces where the comminuted moulding mix is subjected to the effect of high temperatures obtained by means of gas or liquid fuel burners.

Also known are installations for thermal reclamation of resinous moulding mixes, namely installations built in the form of a chamber with a perforated bottom upon which the mix for reclamation is poured. There is an air chamber situated below the perforated bottom, this air chamber including an offtake of air used for fluidization of moulding mix, the temperature required for firing being obtained by means of electric heaters installed directly above the said bottom.

There are imperfections inherent in the above described installations, namely the moulding mix is subject to overheating due to a non-uniform distribution of temperatures in the installation thus causing burning of the granular material. Considerable differences of temperature in the reclamation zone cause, at the same time, the firing process of the moulding mix to be non-uniform, in consequence of which the purity of the reclaimed sand is heterogeneous.

An object of the present invention is to eliminate the above described imperfections by developing an apparatus of a new construction where firing of the mix is obtained by internal and uniform burning of a gas or liquid fuel supplied to the fluidized layer of the mix.

The invented apparatus for reclamation of resinous moulding mixes according to the invention includes at least three chambers contained in a common housing, a heating chamber being situated in the top part of the apparatus, and a firing and a cooling chamber being situated directly below the heating chamber. A chute for the mix to be reclaimed is included in the heating chamber, the bottom of the said chamber forming a fluidizing conveyor terminated with a closure operated by gravity action. The firing chamber is situated below the said closure, said chamber being equipped with a grate with fuel installation and with pipes supplying the combustible mixture. A transfer hole to the cooling chamber is provided in the side wall of the firing chamber at the side opposite to the closure. The bottom of the cooling chamber is a fluidizing conveyor conveying the mix to a discharge hole. The bottom of the heating and cooling chambers are made of elements having, in cross-section, preferably the shape of a sinusoid sector, these elements being superposed on one the another with clearances maintained between them. The grate of the firing chamber is composed of bearing elements with fuel collectors and nozzles attached below, and grate elements. These elements are arranged alternately so as to maintain a clearance between them. Above the grate in the cooling chamber is a cooler, preferably a water cooler, whereas a partition is provided in the heating chamber separating the space above the firing chamber from the space above the cooling chamber.

The construction of the apparatus according to the invention is such that it secures a uniform internal firing of fluidized resinous mix thus allowing the purity of reclaimed sand to be high and homogeneous. This construction also allows a maximum utilization of the combustion energy for obtaining a proper reclamation process.

An embodiment of the apparatus for reclamation of resinous moulding mixes will now be described by way of example and with reference to the accompanying diagrammatic drawing in which.

Figure 1:
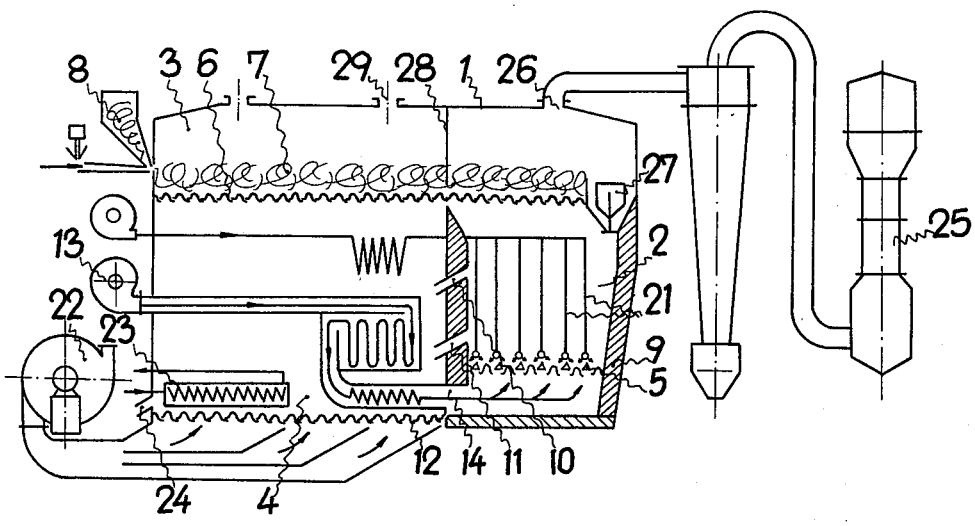
FIG. 1 illustrates the apparatus in a longitudinal section.
Figure 2:
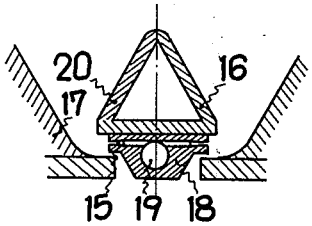
FIG. 2 illustrates in cross-section a portion of the firing chamber grate.
Figure 3:
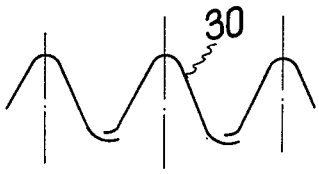
FIG. 3 illustrates in cross-section a portion of the bottom of the cooling and of the heating chamber.

The apparatus according to the invention incorporates three chambers contained in a common housing 1, said chambers being arranged in such manner that a heating chamber 3 is situated above a cooling chamber 4 and above a firing chamber 2, said heating chamber 3 being separated from the latter chambers by a bottom 6, said bottom forming a fluidizing conveyor consisting of elements 30, and elements having in cross-section the shape of sinusoid-like sectors, the edges of the said elements being superposed on one another with a clearance maintained between the elements. A chute 8 is installed at one side of the heating chamber, said chute serving for loading of the apparatus with moulding mix 7, a closure 27 being provided in the heating chamber at the side opposite to the said chute, said closure serving for transfer of the moulding mix to the firing chamber. The heating chamber is divided into two parts by means of a partition 28, the bottom edge of the said partition forming with the plane of the chamber bottom a clearance, said clearance allowing the fluidized mix can be moved along the bottom. Air discharge holes 29 and a combustion gas discharge hole 26 are situated in the top part of the heating chamber, said combustion gas discharge hole being connected with a dry-type deduster and combustion gases neutralizer 25. The firing chamber 2 and the cooling chamber 4, are situated below the heating chamber 3 and are separated from one another by means of an isolating wall, holes 10 for the top transfer of the mix and holes 11 for the bottom transfer of the mix being provided in the said wall. A grate 5 and a duct 14 are provided in the bottom part of the firing chamber, the air fluidizing the moulding mix being supplied through the said duct 14 from a fan 13 to the space below the grate. The grate 5 consists of elements 17 and of bearing elements 16, a clearance 15 being left between the said elements. Fuel collectors 18 are attached to the bearing elements, said collectors including a fuel passage 19 and nozzles 20. The outlets of pipes 21 supplying the combustible mixture are situated above the grate 5. The side walls of the firing chamber are lined with an insulating lining 9. A bottom 12 of the cooling chamber 4 is built-up of elements 30. The air for fluidizing and conveying the reclaimed moulding mix to a discharge hole 24 is supplied from a fan 22 to the space below the bottom. An extra cooling of the reclaimed mix is provided by means of a cooler 23, said cooler being situated above the bottom of the cooling chamber at the same side as the discharge hole 24.

What we claim is:

1. An apparatus for reclamation of resinous molding mixes comprising three fluidizing chambers including a heating chamber, a firing chamber, and a cooling chamber, a common housing for said three chambers, means for supplying a mix to be treated to said heating chamber at one end thereof, said heating chamber being disposed above the other two chambers, a fluidizing conveyor separating said heating chamber from the two chambers therebelow and forming a bottom for said heating chamber on which the mix is conveyed from the supplying means along said conveyor while being first cooled by air flowing upwardly from the cooling chamber and then heated by flow of combustion gases upwardly from the firing chamber, a closure at the other end of the heating chamber for feeding the mix to the firing chamber at one end thereof by gravitional introduction thereinto, said firing chamber having a bottom including a fluidizing grate, means for introducing fluidizing air into said firing chamber below said grate, said mix traveling along said grate to the other end of the firing chamber, pipe means disposed directly above said grate for feeding a fuel mixture in direct proximity to said grate, said firing chamber having, at the other end thereof, a wall separating the firing chamber from the cooling chamber, said wall having aperture means for passage of the mix to said cooling chamber and a further fluidizing conveyor in said cooling chamber for transport of this mix through said cooling chamber to a discharge outlet provided in said housing.

2. Apparatus as claimed in claim 1 wherein the fluidizing conveyors in said heating and cooling chambers respectively comprise a plurality of undulating members superposed on one another and forming clearance spaces therebetween for deflected upward passage of a fluid medium.

3. Apparatus as claimed in claim 2 wherein said undulating members are of sinusoidal shape.

4. Apparatus as claimed in claim 1 wherein said grate includes a plurality of spaced parallel bars of triangular cross-section with bases disposed at a common level, fuel collectors mounted between said bars and having sidewards directed nozzles, said collectors being disposed in spaced relation with the bases of the bars for flow of air into the firing chamber from therebelow.

5. Apparatus as claimed in claim 1 comprising a fixed cooler in said cooling chamber disposed above said further fluidizing conveyor.

6. Apparatus as claimed in claim 1 comprising a dividing vertical partition in said heating chamber disposed above the wall separating the firing chamber from the cooling chamber and spaced above the first fluidizing conveyor for controlled flow of the mix thereon.

* * * * *